US010321791B2

(12) United States Patent
Ciavarella et al.

(10) Patent No.: US 10,321,791 B2
(45) Date of Patent: Jun. 18, 2019

(54) MANUALLY ACTIVATED DISPENSERS FOR SQUEEZABLE BOTTLES

(71) Applicant: GOJO Industries, Inc., Akron, OH (US)

(72) Inventors: Nick E. Ciavarella, Seven Hills, OH (US); Matthew J. Archer, Aurora, OH (US); Michael J. Gallo, Twinsburg, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/817,429

(22) Filed: Nov. 20, 2017

(65) Prior Publication Data

US 2018/0146828 A1 May 31, 2018

Related U.S. Application Data

(60) Provisional application No. 62/427,210, filed on Nov. 29, 2016.

(51) Int. Cl.

| | |
|---|---|
| ***A47K 5/13*** | (2006.01) |
| ***A47K 5/122*** | (2006.01) |
| ***B05B 11/04*** | (2006.01) |
| ***B05B 12/00*** | (2018.01) |
| ***B65D 47/20*** | (2006.01) |

(52) U.S. Cl.

CPC ..... *A47K 5/122* (2013.01); *A47K 5/13* (2013.01); *B05B 11/048* (2013.01); *B05B 12/002* (2013.01); *B65D 47/2018* (2013.01)

(58) Field of Classification Search

CPC ..... A47K 5/122; A47K 5/13; B05B 11/048; B05B 12/002; B65D 47/2018

USPC ..... 222/214

See application file for complete search history.

(56) References Cited

U.S. PATENT DOCUMENTS

| | | | | |
|---|---|---|---|---|
| 3,090,528 A * | 5/1963 | Ronald Ellis | ..... | A47K 5/06 222/179 |
| 4,130,224 A * | 12/1978 | Norman | ..... | G01F 11/088 222/181.2 |
| 4,256,242 A * | 3/1981 | Christine | ..... | G01F 11/088 222/207 |
| 4,324,348 A * | 4/1982 | Johnson | ..... | A47K 5/122 222/181.2 |

(Continued)

FOREIGN PATENT DOCUMENTS

| | | |
|---|---|---|
| GB | 180527 A | 6/1992 |
| KR | 101121455 B1 | 3/2012 |
| WO | 9402109 A2 | 2/1994 |

OTHER PUBLICATIONS

International Search Report and Written Opinion from PCT/US2017/062464 dated Feb. 19, 2018 (16 pages).

*Primary Examiner* — Benjamin R Shaw

(74) *Attorney, Agent, or Firm* — Calfee, Halter & Griswold LLP

(57) ABSTRACT

Another exemplary dispenser includes a refill unit and a refill unit frame member. The refill unit frame member has a bracket for receiving a lower portion of the refill unit. A back plate for mounting the dispenser is also included. An actuator is hingedly connected to the bracket. A curved push bar is connected to the actuator. An anvil is connected to the curved push bar. Movement of the actuator toward the back of the dispenser causes the anvil to move toward the front of the dispenser.

19 Claims, 10 Drawing Sheets

(56) References Cited

U.S. PATENT DOCUMENTS

| | | | | |
|---|---|---|---|---|
| 4,349,133 | A * | 9/1982 | Christine | G01F 11/088 222/183 |
| 4,570,829 | A * | 2/1986 | Allen | B65D 35/40 222/181.2 |
| 4,621,749 | A * | 11/1986 | Kanfer | A47K 5/1215 222/153.01 |
| 4,634,022 | A * | 1/1987 | O'Halloran | A47K 5/1208 222/181.2 |
| 4,722,372 | A * | 2/1988 | Hoffman | A47K 5/1209 137/562 |
| 8,387,832 | B2 | 3/2013 | Zlatic | |
| 8,690,018 | B2 | 4/2014 | Van Der Heijden et al. | |
| 2008/0083786 | A1* | 4/2008 | Marin | A47K 5/122 222/181.3 |
| 2010/0224651 | A1* | 9/2010 | Zlatic | A47K 5/122 222/182 |
| 2012/0048892 | A1* | 3/2012 | van der Heijden | A47K 5/122 222/162 |
| 2012/0199609 | A1* | 8/2012 | Schwenkenberg | A47K 5/122 222/181.3 |

* cited by examiner

MANUALLY ACTIVATED DISPENSERS FOR SQUEEZABLE BOTTLES

RELATED APPLICATIONS

The present application claims the benefits of, and priority to, U.S. Provisional Patent Application Ser. No. 62/427,210, titled MANUALLY ACTUATED DISPENSERS FOR SQUEEZABLE BOTTLES, which was filed on Nov. 29, 2016 and is incorporated herein by reference in its entirety.

TECHNICAL FIELD

The present invention relates generally to liquid dispenser systems, such as liquid soap and sanitizer dispensers, and more particularly to manual dispensers for dispensing fluid squeezable bottles.

BACKGROUND OF THE INVENTION

Liquid dispensing systems, such as liquid soap and sanitizer dispensers, provide a user with an amount of liquid or foam upon actuation of the dispenser.

SUMMARY

Exemplary embodiments of dispensers and refill units disclosed herein.

An exemplary dispensing system includes a refill unit having a top and a bottom. The refill unit includes a resilient container, a pressure activated liquid outlet valve in fluid communication with the resilient container and an outlet in fluid communication with the pressure activated outlet valve and disposed at the bottom of the refill unit. The dispenser further includes a frame having an upper end and a lower end. An upper retainer is attached to the upper end and is configured to receive the top of the refill unit. A lower retainer is attached to the lower end of the frame and is configured to receive the bottom of the refill unit. An anvil configured to engage the resilient container when the dispensing system is actuated is also included. The dispenser includes actuator hingedly connected to the lower receptacle and extending below the lower receptacle. The actuator is connected to the anvil.

Another exemplary dispenser includes a base portion and a refill unit frame member. The refill unit frame member includes an upper retaining member for receiving an upper portion of a refill unit, a lower retaining member for receiving a lower portion of the refill unit and an actuator connected to the lowered retaining member. A hinge connects the refill unit frame member to the base portion. A container for holding a liquid to be displaced is also included. An anvil is secured to the base. Applying a force to the actuator causes the refill frame member to pivot toward the anvil and wherein the anvil compresses the container to dispense fluid from the container.

Another exemplary dispenser includes a refill unit and a refill unit frame member. The refill unit frame member has a bracket for receiving a lower portion of the refill unit. A back plate for mounting the dispenser is also included. An actuator is hingedly connected to the bracket. A curved push bar is connected to the actuator. An anvil is connected to the curved push bar. Movement of the actuator toward the back of the dispenser causes the anvil to move toward the front of the dispenser.

In one exemplary embodiment, a liquid dispensing system includes a refill unit, a frame, an anvil portion, and an actuator. The refill unit has a top and a bottom and includes a resilient container, a one-way outlet valve in fluid communication with the resilient container, and an outlet in fluid communication with the one-way outlet valve and disposed at the bottom of the refill unit. The frame has an upper end and a lower end and includes an upper receptacle attached to the upper end, a lower receptacle attached to the lower end, and an aperture in the lower receptacle substantially aligned with the outlet of the refill unit. The upper receptacle is configured to receive the top of the refill unit and the lower receptacle is configured to receive the bottom of the refill unit. The anvil portion is configured to engage the resilient container when the dispensing system is actuated. The actuator is attached to and extends below the lower receptacle.

BRIEF DESCRIPTION OF THE DRAWINGS

These and other features and advantages of the present invention will become better understood with regard to the following description and accompanying drawings in which.

DETAILED DESCRIPTION

Prior to discussing the various embodiments, a review of the definitions of some exemplary terms used throughout the disclosure is appropriate. Both singular and plural forms of all terms fall within each meaning.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

Figure 1A:
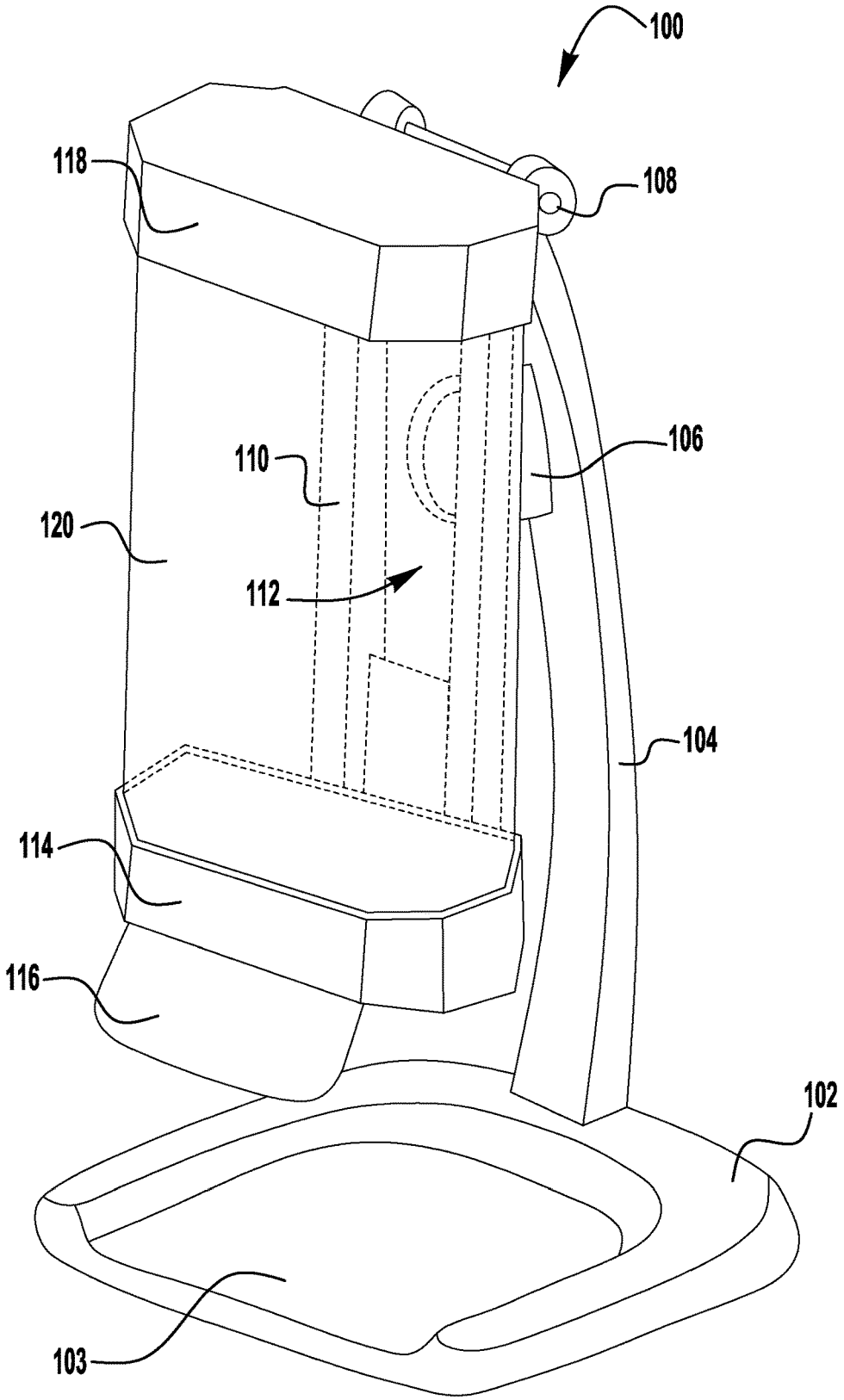
FIG. 1A is a perspective view of an exemplary dispenser having a refill unit.
Figure 1B:
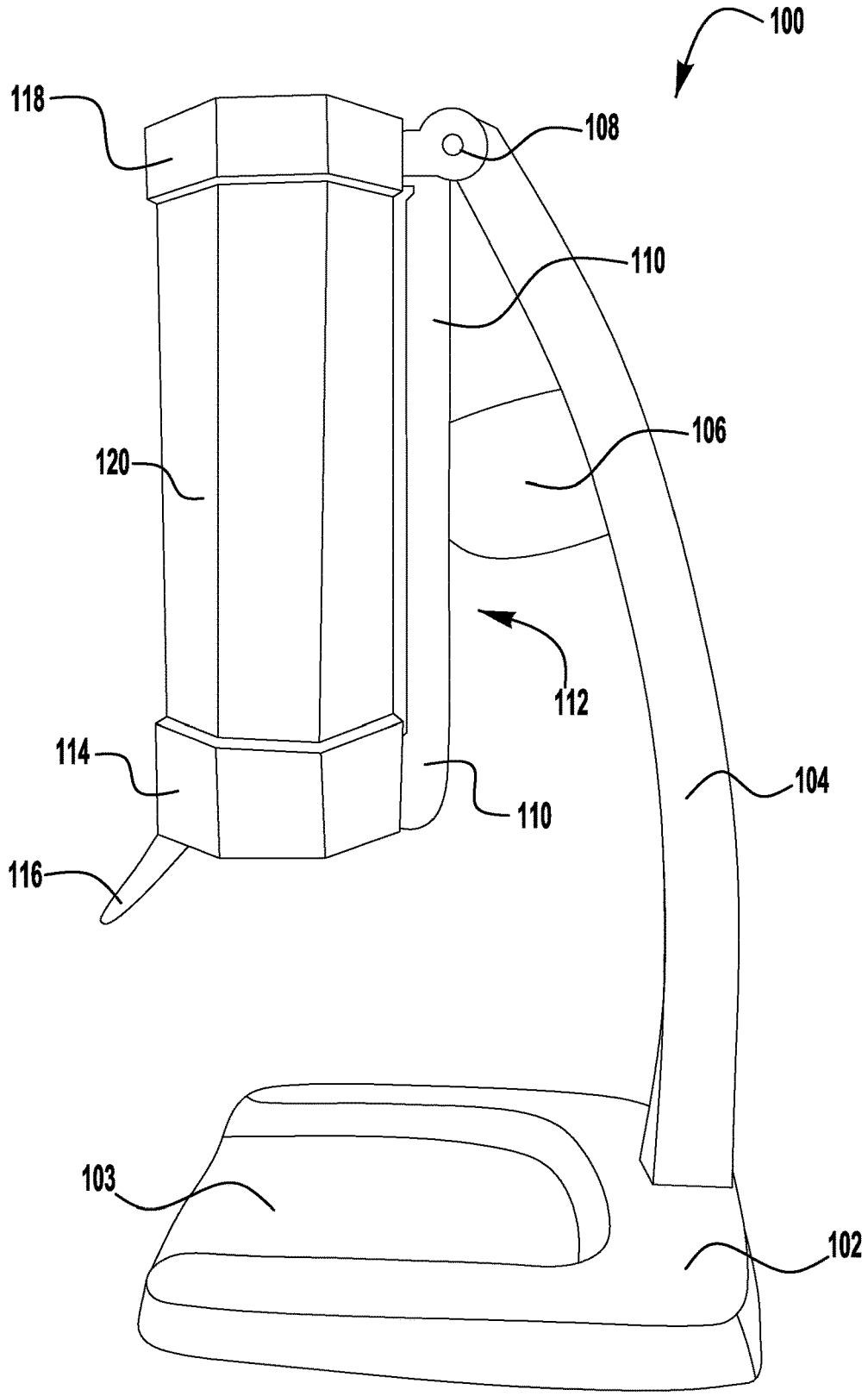
FIG. 1B is a side view of the exemplary dispenser having a refill unit of FIG. 1A.
Figure 2A:
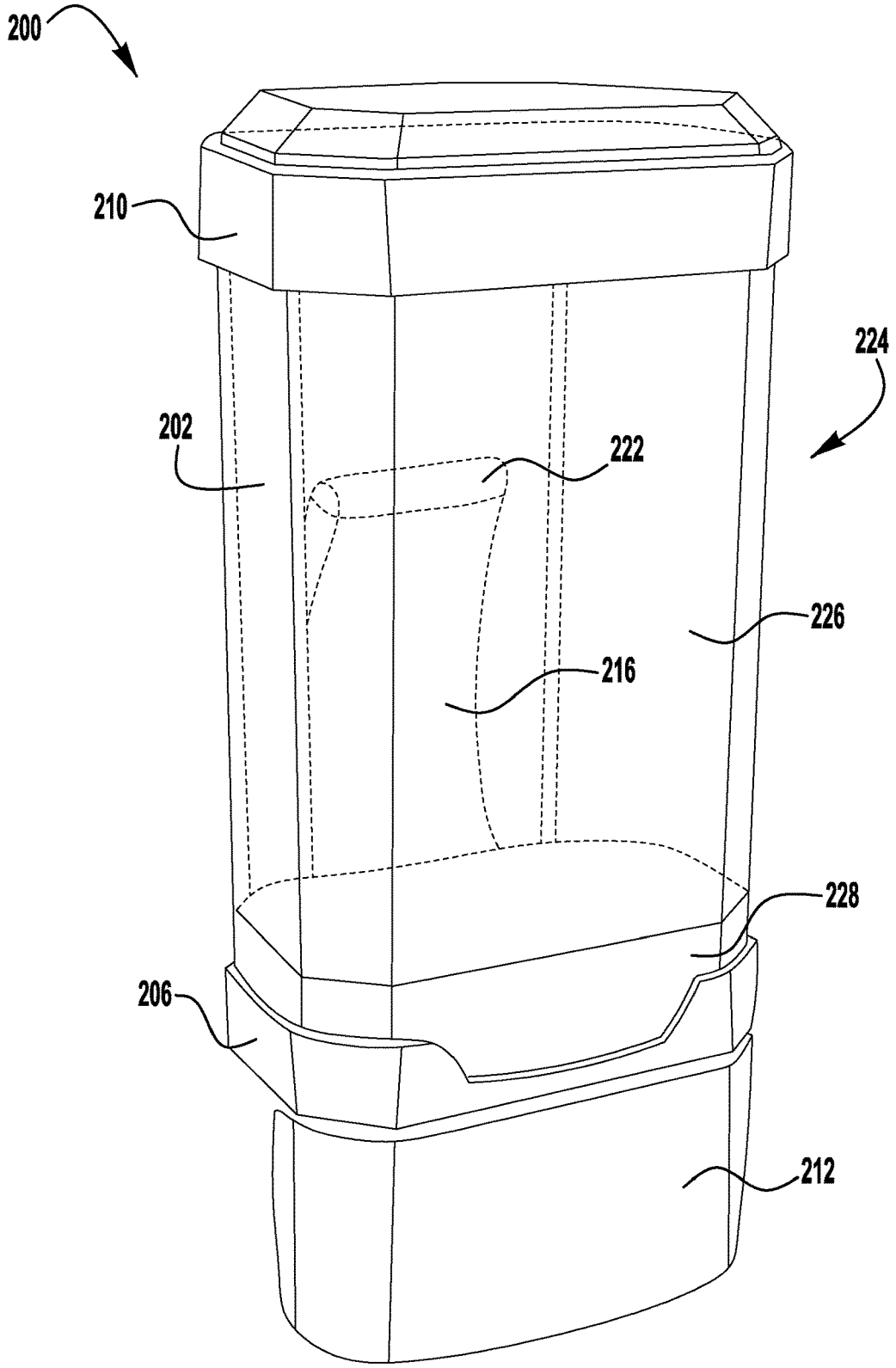
FIG. 2A is a perspective view of an exemplary dispenser having a refill unit.
Figure 2B:
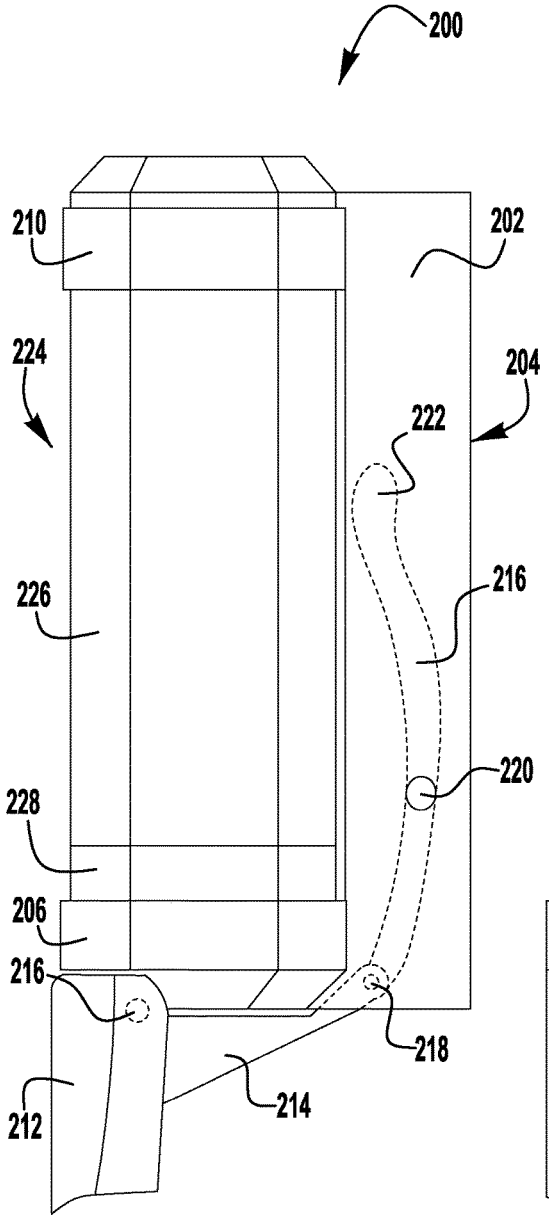
FIG. 2B is a side view of the exemplary dispenser having a refill unit of FIG. 2A.
Figure 2C:
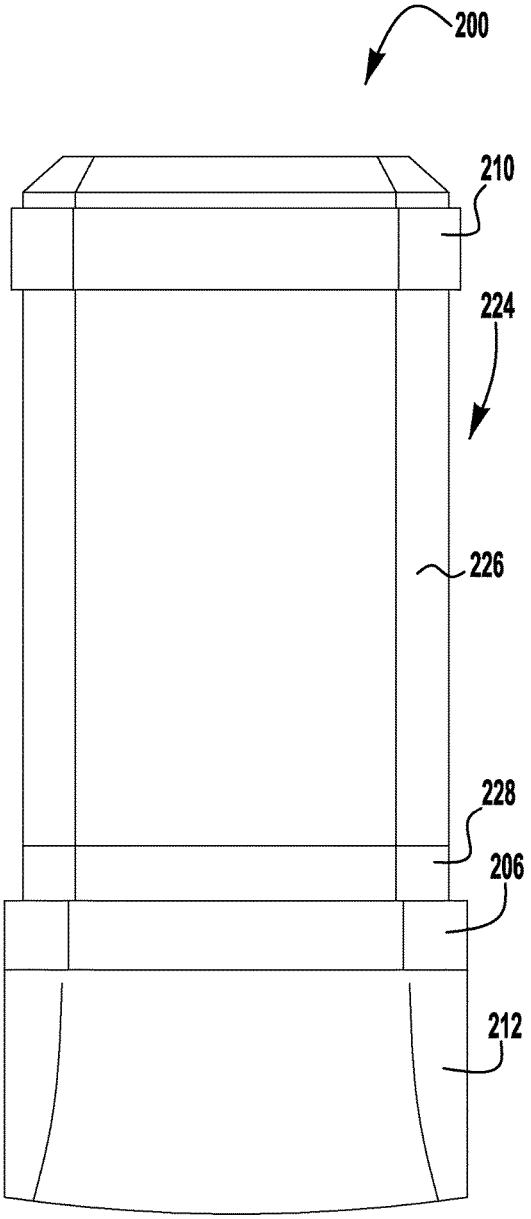
FIG. 2C is a front view of the exemplary dispenser having a refill unit of FIG. 2A.
Figure 2D:
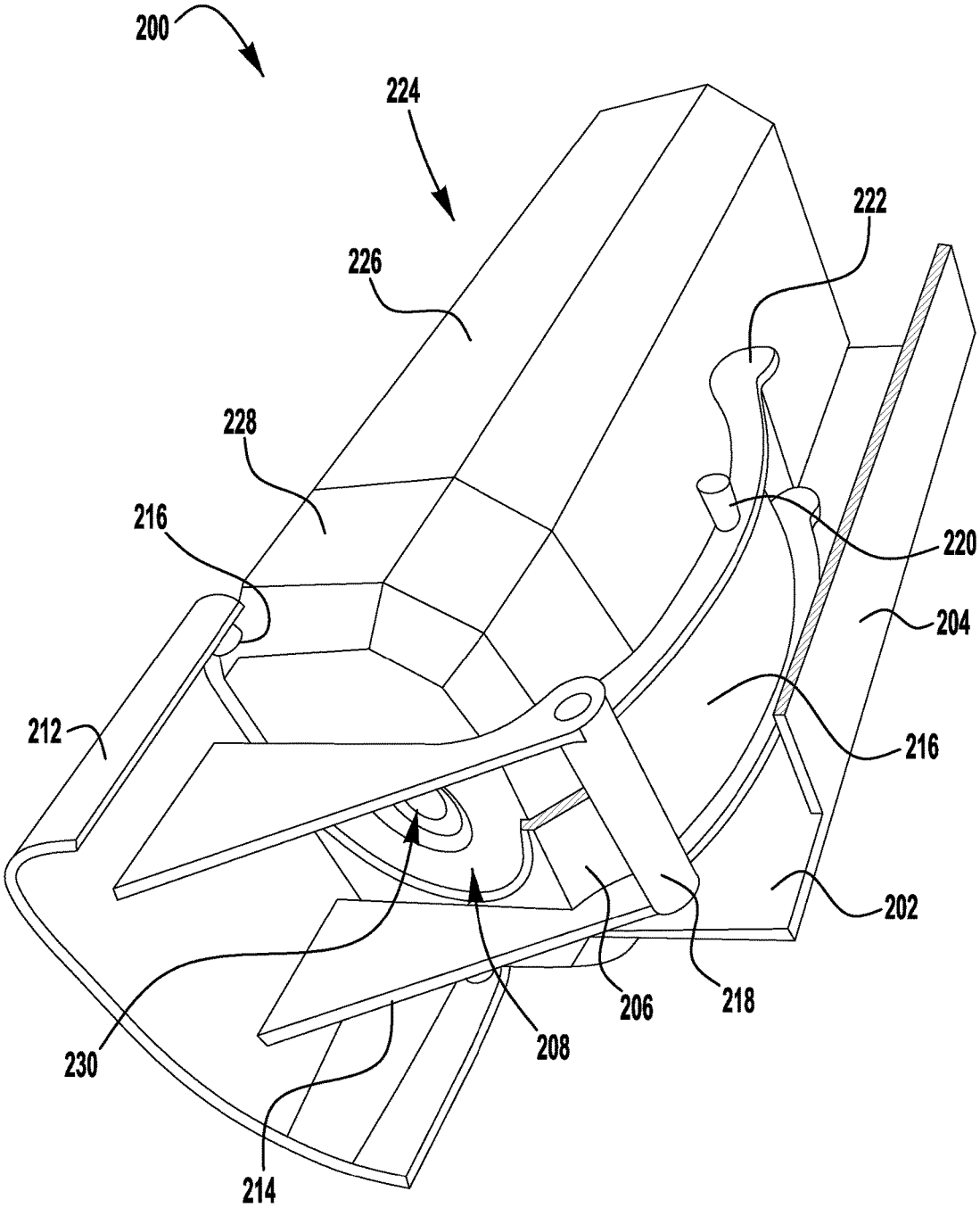
FIG. 2D is a partial rear perspective view of the exemplary dispenser having a refill unit of FIG. 2A, with a portion of the frame removed to reveal the actuation mechanism.
Figure 2E:
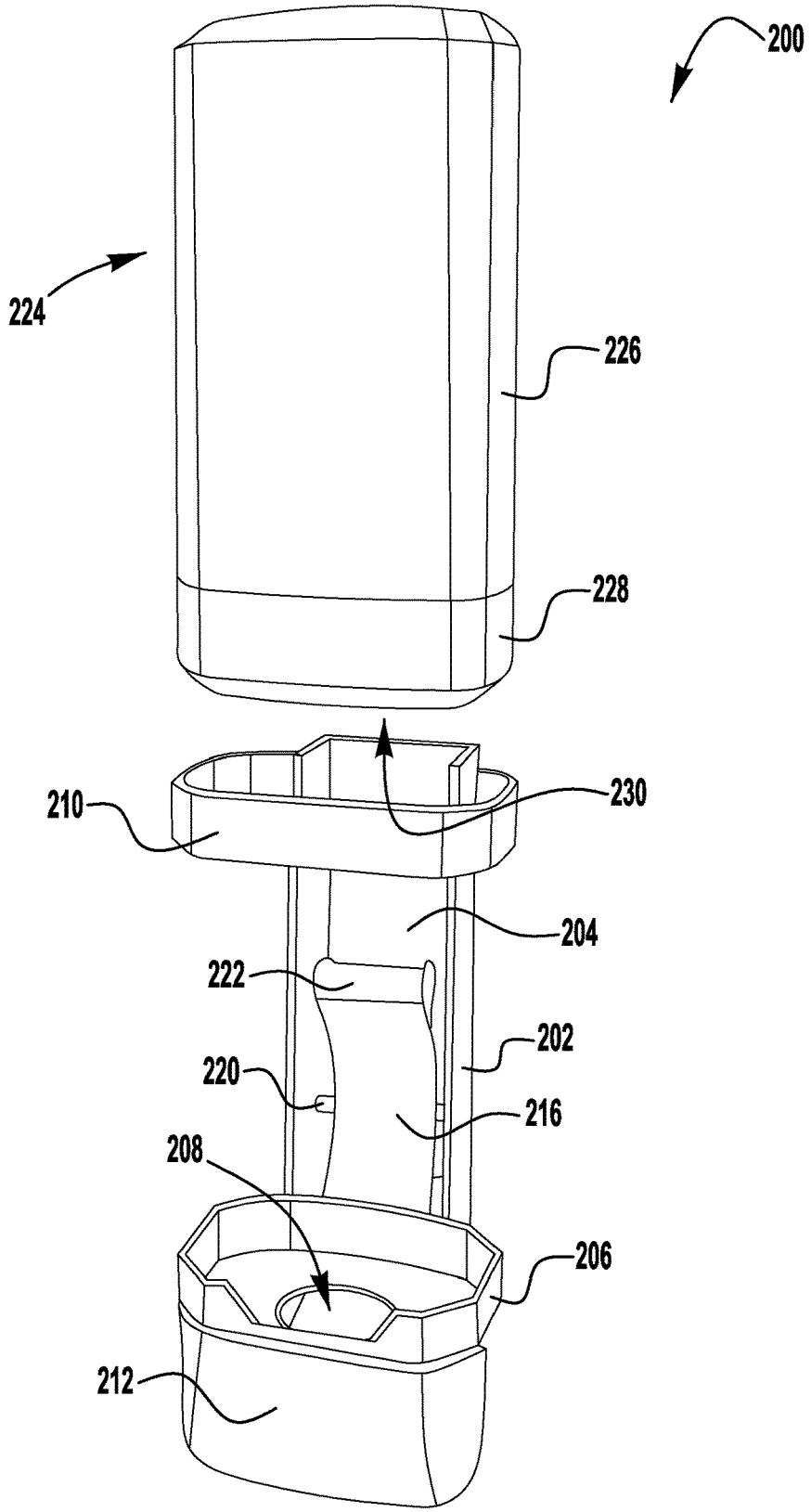
FIG. 2E is a front perspective view of the exemplary dispenser having a refill unit of FIG. 2A, with the refill unit removed from the dispenser.
Figure 3A:
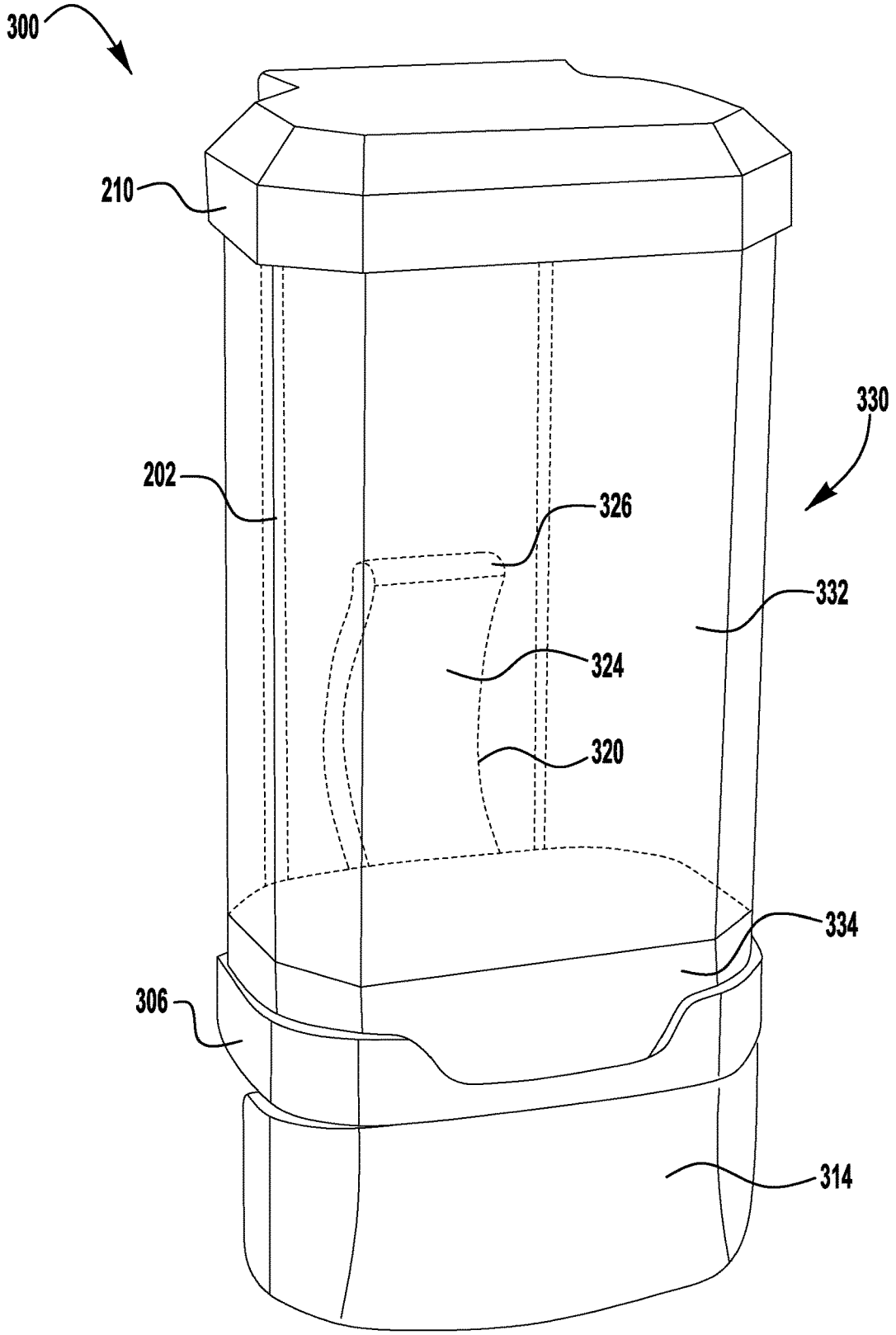
FIG. 3A is a front-left-top perspective view of an exemplary dispenser having a refill unit.
Figure 3B:
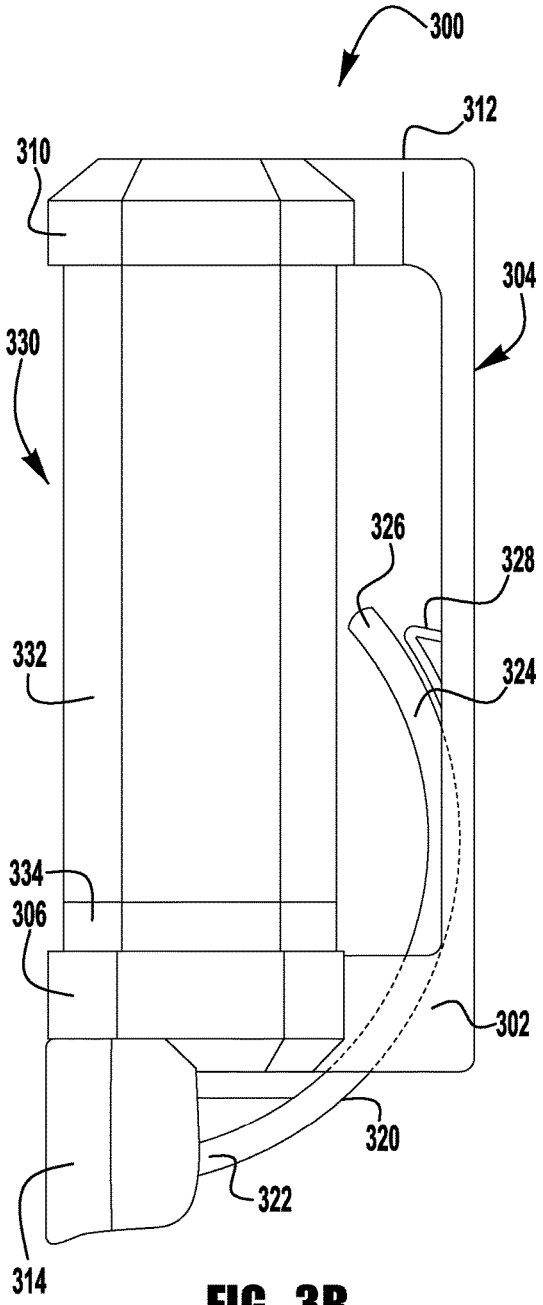
FIG. 3B is a side view of the exemplary dispenser having a refill unit of FIG. 3A.
Figure 3C:
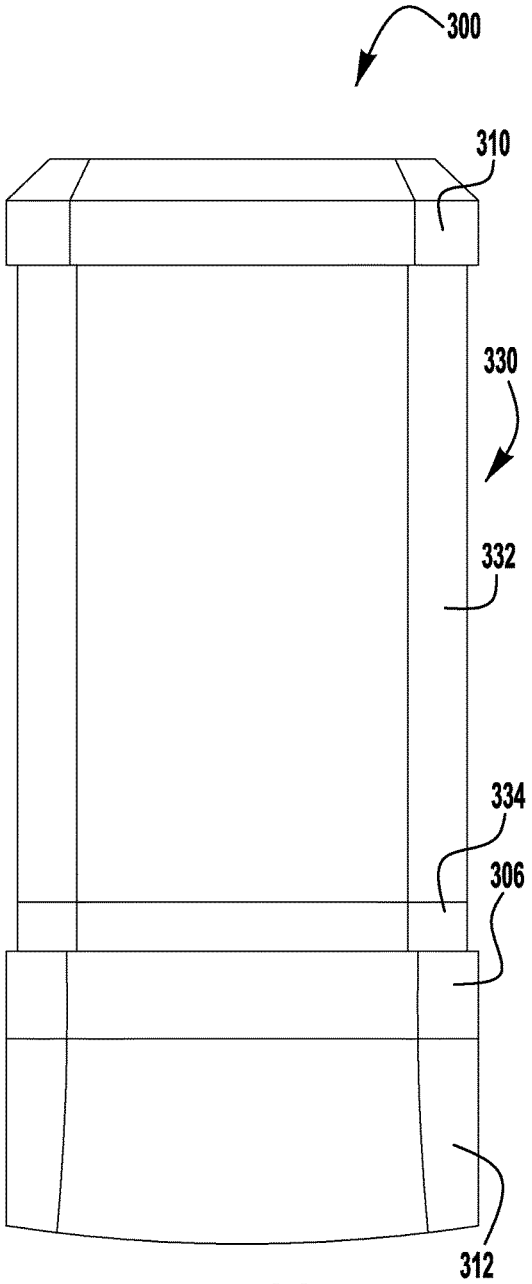
FIG. 3C is a front view of the exemplary dispenser having a refill unit of FIG. 3A.
Figure 3D:
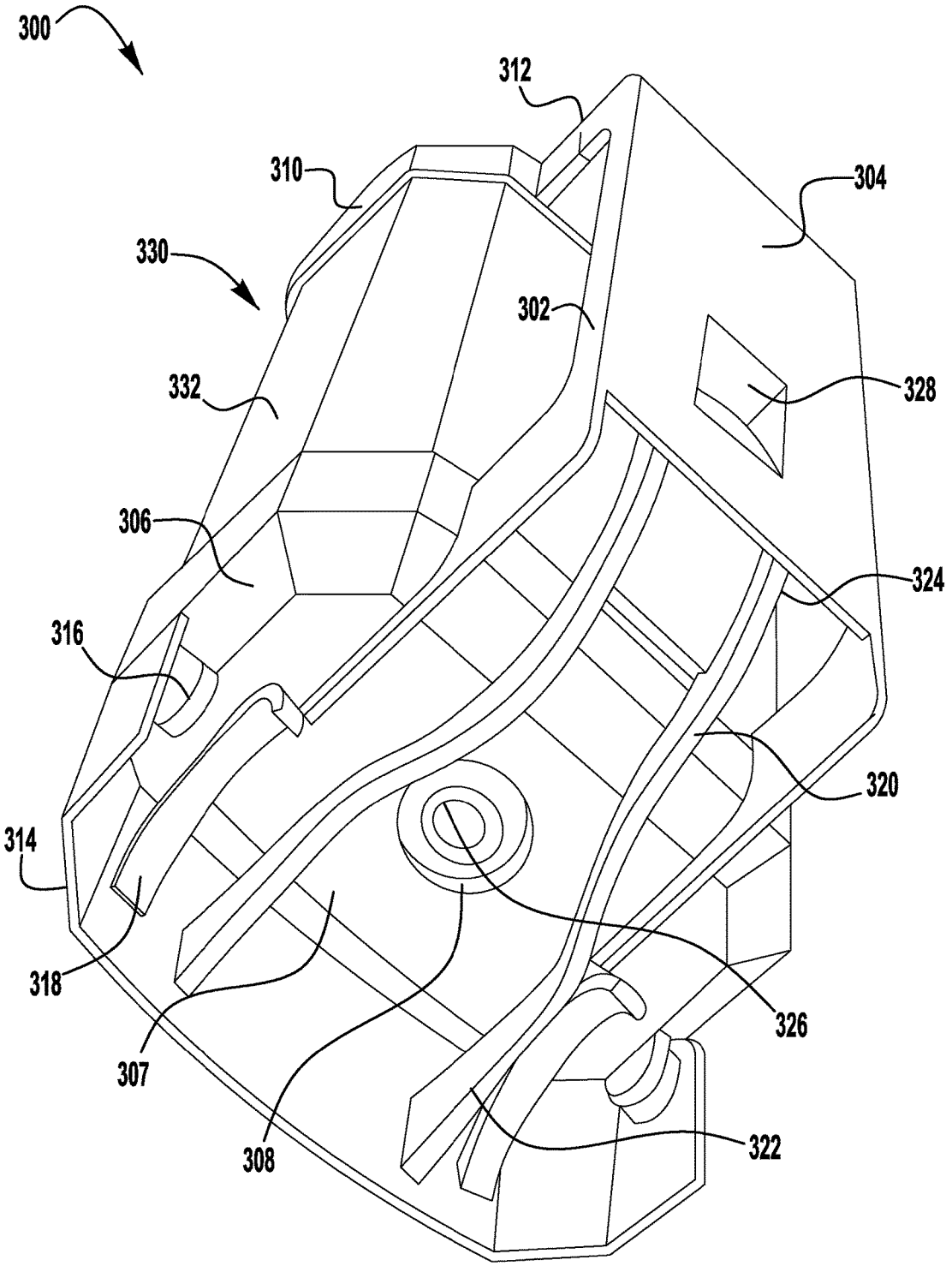
FIG. 3D is a bottom perspective view of the exemplary dispenser having a refill unit of FIG. 3A.
Figure 3E:
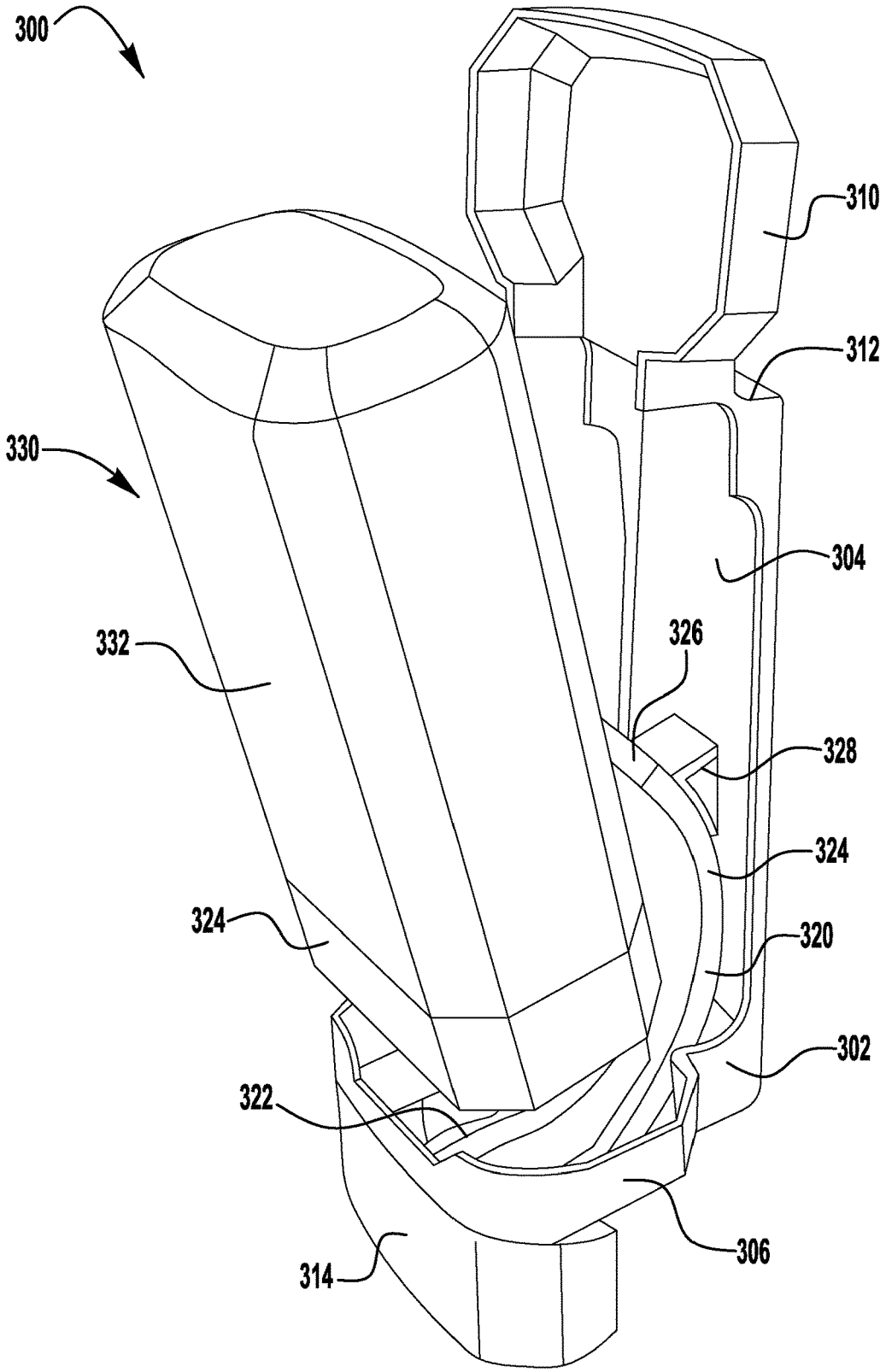
FIG. 3E is a perspective view of the exemplary dispenser having a refill unit of FIG. 3A, with the refill unit partially removed from the dispenser.

Referring now to FIGS. 1A and 1B, an exemplary embodiment of a dispenser 100 having a disposable refill unit 120 is shown. The dispenser 100 is a table-top dispenser that is supported by a support arm 104 above a base 102 that rests on a table-top or any other surface, such as, for example, a counter top, a shelf, or the like. The dispenser 100 may be a mounted system, or may be an un-mounted portable system movable from place to place, or any other kind of dispenser system. The base 102 includes a drip tray 103 formed by a recessed portion in the top surface of the base. The drip tray 103 catches excess soap or sanitizer that may drip from the dispenser 100 after use. In some embodiments support arm 104 may be a wall mounting bracket so that the dispenser 100 may be mounted to a wall.

The support arm 104 extends upward from the base 102 to a hinge 108 that hingeably attaches a frame 110 and an upper receptacle 118 to the support arm 104. The support arm 104 includes an anvil 106 that engages the refill unit 120 through an opening 112 in the frame 110 when the user presses on an actuator 116 to actuate the dispenser 100. The frame 110 extends downward from the hinge 108 to a lower receptacle 114 that includes a actuator 116 on its front. The upper and lower receptacles 118, 114 are configured to receive and support the top and bottom of the refill unit 120, respectively. The receptacles 114, 118 and the frame 110 support the refill unit 120 and allow the refill unit 120 to be pivoted about hinge 108 when the user pushes on the actuator 116. The receptacles 114, 118 also prevent the refill unit 120 from moving laterally when it is compressed by the anvil 106 during actuation. The actuator 116 extends downward from the receptacle and provides a natural push bar for the user to engage to receive a dose of liquid. The actuator 116 is positioned so that when the user presses the actuator 116 the hand is located below the outlet nozzle of the refill unit 120.

The refill unit 120 includes a container 122 and a cap 124 disposed at the bottom of the container 122. The container 122 forms a liquid reservoir that contains a supply of dispensable liquid within the disposable refill unit 120. In various embodiments, the contained liquid could be, for example, a soap, a sanitizer, a cleanser, a disinfectant, a foamable liquid, or some other dispensable liquid. In the exemplary disposable refill unit 120, the container 122 is a flexible and resilient container that returns to substantially its original form after being squeezed or pressed. In some embodiments, the container 122 is formed of clear plastic, such as for example, polyethylene terephthalate plastic so that the level of the liquid inside the container 122 can be seen by the user. In some embodiments, the container 122 is dimpled where the anvil 106 engages the container 122 to facilitate the generation of pressure inside the container 122 during actuation.

The cap 124 of the refill unit 120 includes a valve (not shown) in fluid communication with the container 122 and a outlet nozzle (not shown) in fluid communication with the valve. The valve is a pressure-actuated one-way valve that is oriented such that it allows flow out of the container 122 through the outlet nozzle when the pressure of the liquid inside the container 122 exceeds an actuation pressure threshold. The valve can be any kind of one-way valve, such as a cross-cut valve, a ball and spring valve, a wiper valve, a poppet valve, a flapper valve, an umbrella valve, a slit valve, a mushroom valve, a duck bill valve, or the like.

The dispenser 100 is capable of single-handed operation, i.e., the user can push the actuator 116 with the palm of one upward facing hand to dispense liquid into that same hand. During operation of the dispenser 100, the user presses forward on the actuator 116 to cause the frame 110 and refill unit 120 to pivot about hinge 108. As the frame 110 and refill unit 120 swivel backward the anvil 106 engages the container 122 causing it to compress, thereby increasing the pressure on the liquid stored inside the container 122. When the pressure on the liquid exceeds the actuation pressure threshold of the valve, liquid is dispensed from the container 122 through the outlet nozzle and into the user's hand. When the user removes their hand from the actuator 116, the resilient container 122 is allowed to expand back to its original shape. The expanding container 122 pushes on the anvil 106 until the frame 110 and refill unit 120 are in their original position. In some embodiments, the container 122 also includes a vent (not shown) to allow air to enter the container 122 as it expands to its uncompressed state after being actuated, thereby preventing a low pressure condition in the container 122 that could prevent the container 122 from returning to its original shape.

The container 122 may advantageously be refillable, replaceable or both refillable and replaceable. In the event the liquid stored in the container 122 of the installed disposable refill unit 120 runs out, or the installed refill unit 120 otherwise has a failure, the installed refill unit 120 may be removed from the dispenser 100. To remove the refill unit 120, the user lifts, or rotates, the upper receptacle 118 to free the upper end of the refill unit 120. The empty or failed disposable refill unit 120 may then be removed vertically and replaced with a new disposable refill unit 120 and the upper receptacle 114 lowered to hold the new refill unit 120 in place.

Referring now to FIGS. 2A-2E, an exemplary dispenser 200 having a disposable refill unit 224 is shown. The dispenser 200 is a wall-mountable dispenser that may be attached to a wall or other vertical surface via a back plate 204 of a frame 202 that supports the refill unit 224 and the actuation mechanism 212 of the dispenser 200. The frame 202 extends from a lower receptacle 206 disposed near the bottom of the frame 202 to an upper bracket 210 disposed near the top of the frame 202. The lower receptacle 206 and bracket 210 receive and support the bottom and top of the refill unit 224, respectively. The lower receptacle 206 and upper bracket 210 also prevent the refill unit 224 from moving laterally or tipping forward during actuation of the dispenser 200. An aperture 208 in the lower receptacle 206 allows liquid to be dispensed from the refill unit 224 when the dispenser 200 is actuated.

The refill unit 224 includes a container 226, a cap 228 disposed at the bottom of the container 226, and a outlet 230 in the cap 228. The outlet 230 includes a valve (not shown). The container 226 forms a liquid reservoir that contains a supply of dispensable liquid within the disposable refill unit 224. In various embodiments, the contained liquid could be for example a soap, a sanitizer, a cleanser, a disinfectant, a foamable liquid, or some other dispensable liquid. In the exemplary disposable refill unit 224, the container 226 is formed of a flexible and resilient material that allows the container 226 to return substantially to its original form after being squeezed or pressed. In some embodiments, the container 226 is formed of clear plastic, such as, for example, polyethylene terephthalate plastic so that the level of the liquid inside the container 226 can be seen by the user.

The container 226 may advantageously be refillable, replaceable or both refillable and replaceable. In the event the liquid stored in the container 226 of the installed disposable refill unit 224 runs out, or the installed refill unit 224 otherwise has a failure, the installed refill unit 224 may be removed from the dispenser 200 by sliding the refill unit 224 upward to disengage the refill unit 224 from the lower receptacle 206 and slide the refill unit 224 through the upper bracket 210. The empty or failed disposable refill unit 224 may then be replaced with a new disposable refill unit 224.

The valve (not shown) in outlet 230 is in fluid communication with the container 226. The refill unit 224 may also include a nozzle (not shown) in fluid communication with the valve 230. The valve is a pressure-actuated one-way valve that is oriented such that it allows flow out of the refill unit 224 when the pressure of the liquid inside the container 226 exceeds an actuation pressure threshold. In some embodiments, the valve is a pressure-actuated two-way valve that allows fluid under pressure to flow out of container 226, and also allows air to flow back into container 226 when there is a negative pressure in the container 226. The valve can be any kind of one-way valve, such as a cross-cut valve, a ball and spring valve, a wiper valve, a poppet valve, a flapper valve, an umbrella valve, a slit valve, a mushroom valve, a duck bill valve, or the like. The valve could be any kind of two-way valve that allows liquid to be forced out of the container 226 under positive pressure and allows air to flow into the container 226 when there is negative pressure in the container. In some embodiments, the cap includes a one-way air inlet valve that allows air to flow into the container when there is a negative pressure in the container 226.

The dispenser 200 is actuated when the user presses on an actuator 212 which is hingedly connected to the lower receptacle 206 via hinge 214. Actuator 212 extends below the bottom of the container 226 and is a user activated push bar intuitively manipulated by a user to receive a dose of fluid. When a user's hand is positioned to press actuator 212, user's hand is correctly positioned underneath the outlet for receiving a dose of fluid. A lower bar 214 extends rearward from the actuator 212 to a hinge 218 that hingeably connects an upper push bar 216 to the lower push bar 214. The upper push bar 216 is hingeably connected to the frame 202 at a hinge 220. The upper push bar 216 includes an anvil portion 222 at its upper end that engages the container 226 of the refill unit 224 when the actuator 212 is pressed. In some embodiments, frame 202 has a slot that receives hinge 220. Accordingly, upper push bar 216 may have some upward movement during actuation. Thus any upward forces acting on hinge 218 and upper push bar 216 from movement of lower bar 214, may be accounted for. In some embodiments, upper push bare 216 has an arcuate shape. In some embodiments, upper push bar 216 is not connected to frame 202 at hinge 220 but rather the curved back portion of the upper push bar 216 context back plate 204 and movement of the hinged section 218 causes and anvil 222 to compress container 226.

The dispenser 200 is capable of single-handed operation, i.e., the user can push the actuator 212 with the palm of one upward facing hand to dispense liquid into that same hand. During operation of the dispenser 200, the user presses on the actuator 212 causing the actuator 212 and lower bar 214 to move rearward. Movement of the actuator 212 rearward causes the hinge 218 joining the lower bar 214 and upper push bar 216 to move rearward and slightly upward, pivoting the upper push bar 216 around the hinge 220, thereby causing the anvil portion 222 to engage and compress the container 226. The pressure on the liquid stored inside the container 226 increases as the container 226 is compressed. When the pressure on the liquid exceeds the actuation pressure threshold of the valve 230, liquid is dispensed from the refill unit 224 and into the user's hand. In some embodiments, the movement of at least one of the actuator 212, lower bar 214, and upper push bar 216 is limited to control the amount of liquid that can be dispensed from the dispenser 200 during actuation. In some embodiments, the amount of liquid dispensed during a single actuation cycle of the dispenser 200 is adjustable by adjusting, for example, the length of lower push bar 214 or angle of upper push bar 216.

When the user removes their hand from the actuator 212, the container 226 is allowed to expand substantially to its original condition. The expanding container 226 pushes on the anvil portion 222 causing the lower bar 214, upper push bar 216 and actuator 212 to return to their original position. In some embodiments, the container 226 also includes a vent (not shown) to allow air to enter the container 226 as it expands to its uncompressed state after being actuated, thereby preventing a low pressure condition in the container 226 that could prevent the container 226 from returning to its original shape. In some embodiments, a resilient biasing member (not shown) biases actuator 212 towards its unactuated state.

Referring now to FIGS. 3A-3E, an exemplary dispenser 300 having a disposable refill unit 330 is shown. The dispenser 300 is a wall-mounted dispenser that is attached to a wall or other vertical surface via a back plate 304 of a frame 302 that supports the refill unit 330 and the actuation mechanism of the dispenser 300. The frame 302 extends from a lower receptacle 306 disposed near the bottom of the frame 302 to an upper receptacle 310 disposed near the top of the frame 302. The upper receptacle 310 is hingably attached to the frame 302 with a hinge 312. In the illustrated embodiment, the receptacles 306, 310 and hinge 312 are integrally formed with the frame 302, with the hinge 312 being formed by a bendable portion of the material forming the frame 302 and upper receptacle. The lower receptacle 306 and receptacle 310 receive and support the bottom and top of the refill unit 330, respectively. The lower receptacle 306 and upper receptacle 310 also prevent the refill unit 330 from moving laterally or tipping forward during actuation of the dispenser 300. An aperture 308 in the lower receptacle 306 allows liquid to be dispensed from the refill unit 330 when the dispenser 300 is actuated.

The refill unit 330 includes a container 332, a cap 324 disposed at the bottom of the container 332, and a valve 336 in the cap 334. The container 332 forms a liquid reservoir that contains a supply of dispensable liquid within the disposable refill unit 330. In various embodiments, the contained liquid could be for example a soap, a sanitizer, a cleanser, a disinfectant, a foamable liquid, or some other dispensable liquid. In the exemplary disposable refill unit 330, the container 332 is formed of a flexible and resilient material that allows the container 332 to return substantially to its original form after being squeezed or pressed. In some embodiments, the container 332 is formed of clear plastic, such as, for example, polyethylene terephthalate plastic so that the level of the liquid inside the container 332 can be seen by the user.

The container 332 may advantageously be refillable, replaceable or both refillable and replaceable. In the event the liquid stored in the container 332 of the installed disposable refill unit 324 runs out, or the installed refill unit 330 otherwise has a failure, the installed refill unit 330 may be removed from the dispenser 300 by first lifting the upper receptacle 310 upward to free the refill unit 330 from the upper receptacle 310 and then lifting the refill unit upward to disengage the refill unit 330 from the lower receptacle 306. The empty or failed disposable refill unit 332 may then be replaced with a new disposable refill unit 332.

The valve 336 is in fluid communication with the container 332. The refill unit 330 may also include a nozzle (not shown) in fluid communication with the valve 336. The valve 336 is a pressure-actuated one-way valve that is oriented such that it allows flow out of the refill unit 330 when the pressure of the liquid inside the container 332 exceeds an actuation pressure threshold. The valve 336 can be any kind of one-way valve, such as a cross-cut valve, a ball and spring valve, a wiper valve, a poppet valve, a flapper valve, an umbrella valve, a slit valve, a mushroom valve, a duck bill valve, or the like. In some embodiments, valve 336 is a two-way valve in allows fluid under pressure to flow out of the container 332 and allows air to flow into the container 332 when there is a negative pressure in the container.

The dispenser 300 is actuated when the user presses on an actuator 314 hingeably attached to the lower receptacle 306 at a hinge 316. Actuator 314 extends below the bottom of the container and provides an intuitive push bar for users to manipulate in order to receive a dose of liquid. Resilient biasing members 318 extends rearward and upward from the actuator 314 to engage the lower receptacle 306 and a portion of frame 302. The resilient biasing members 318 press against the lower receptacle 310 when the actuator 314 is actuated and causes the actuator 314 to return to its original position after an actuation cycle. In some embodiments resilient spring member 318 is a spring.

A push bar 320 extends rearward from the actuator 314. Push bar 320 curves upward and behind the refill unit 330. When actuator 314 is manipulated, the upper portion of push bar 320 engages the container 332. In this exemplary embodiment, a lower portion 322 of the push bar 320 includes two members that are spaced apart to allow liquid to be dispensed between them from the refill unit 330 during actuation. An upper portion 324 of the push bar 320 joins the spaced apart members of the lower portion 322 and extends upward to an anvil portion 326 of the push bar 320. The anvil portion 336 engages the container 332 of the refill unit 330 when the actuator 314 is pressed and compresses container 332. A guide portion 328 extends forward from the back plate 304 to engage the upper portion 324 of the push bar 320 and to direct the force exerted on the actuator 314 toward the rear of the container 332.

The dispenser 300 is capable of single-handed operation, i.e., the user can push the actuator 314 with the palm of one upward facing hand to dispense liquid into that same hand. During operation of the dispenser 300, the user presses on the actuator 314 causing the actuator 314 and push bar 320 to pivot rearward around the hinge 316. Movement of the actuator 314 rearward causes the push bar 320 to move rearward and upward, sliding along the curve of the guide portion 328, thereby causing the anvil portion 326 to engage and compress into the container 332. The pressure of the liquid stored inside the container 332 increases as the container 332 is compressed. When the pressure of the liquid exceeds the actuation pressure threshold of the valve 336, liquid is dispensed from the refill unit 330 and into the user's hand. In some embodiments, the movement of at least one of the actuator 314 and push bar 320 is limited to control the amount of liquid that can be dispensed from the dispenser 300 during actuation. In some embodiments, the amount of liquid dispensed during a single actuation cycle of the dispenser 300 is adjustable.

When the user removes their hand from the actuator 314, the container 332 is allowed to expand substantially to its original condition. The expanding container 332 pushes on the anvil portion 326 and the spring members 318 push against the lower receptacle 306 causing the push bar 320 and actuator 314 to return to their original position. In some embodiments, the container 332 also includes a vent (not shown) to allow air to enter the container 332 as it expands to its uncompressed state after being actuated, thereby preventing a low pressure condition in the container 332 that could prevent the container 332 from returning to its original shape.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated. Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A dispensing system comprising:

a refill unit having a top and a bottom, the refill unit comprising:

a resilient container;

a pressure activated liquid outlet valve in fluid communication with the resilient container; and an outlet in fluid communication with the pressure activated outlet valve and disposed at the bottom of the refill unit;

a frame having an upper end and a lower end, the frame comprising:

an upper retainer attached to the upper end and configured to receive the top of the refill unit;

a lower retainer attached to the lower end of the frame and configured to receive the bottom of the refill unit; and an anvil configured to engage the resilient container when the dispensing system is actuated; and an actuator hingedly connected to the lower retainer and extending below the lower receptacle;

wherein the actuator is connected to the anvil; and wherein the actuator is connected to the anvil through a hinge.

2. The dispensing system of claim 1, wherein the anvil is disposed between the upper and lower ends of the frame.

3. The dispensing system of claim 1, wherein moving the actuator toward the rear of the dispenser moves the anvil portion forward to engage the resilient container.

4. The dispensing system of claim 1, wherein the actuator includes one or more biasing members to return the actuator to an unactuated state.

5. The dispensing system of claim 4, further comprising a curved push bar connecting the actuator to the anvil.

6. The dispensing system of claim 1, wherein the actuator is connected to the anvil with a lower bar attached to the actuator;

an upper push bar moveably attached to the frame; and a hinge portion hingeably connecting the lower bar to the upper push bar and the anvil is located at the distal end of the upper push bar.

7. The dispensing system of claim 1, wherein the actuator is connected to the anvil with a curved push bar.

8. A dispenser comprising:

a base portion that is configured to rest on a surface;

a refill unit frame member, the refill unit frame member having;

an upper retaining member for receiving an upper portion of a refill unit;

a lower retaining member for receiving a lower portion of the refill unit;

an actuator connected to the lowered retaining member;

a hinge connecting the refill unit frame member to the base portion;

a container for holding a liquid to be displaced;

a pressure activated outlet valve secured to the container;

an anvil secured to a support arm extending upward from the base;

wherein applying a force to the actuator causes the refill frame member to pivot toward the anvil and wherein the anvil compresses the container to dispense fluid from the container through the pressure activated outlet valve.

9. The dispenser of claim 8 further comprising a drip tray in the base.

10. The dispenser of claim 8 wherein the lower retaining member is a receptacle and includes an aperture for dispensing fluid through.

11. The dispenser of claim 8 wherein the upper retaining member is a receptacle that is hingedly connected to the base.

12. A dispenser comprising:

a refill unit;

the refill unit comprising a container and a pressure activated outlet valve;

a refill unit frame member;

the refill unit frame member having a bracket for receiving a lower portion of the refill unit;

a back plate for mounting the dispenser;

an actuator hingedly connected to the bracket;

a curved push bar connected to the actuator;

an anvil connected to the curved push bar;

wherein movement of the actuator toward the back of the dispenser causes the anvil to move toward the front of the dispenser.

13. The dispenser of claim 12 wherein the curved push bar is hingedly connected to the actuator.

14. The dispenser of claim 12 wherein the curved push bar is rigedly connected to the actuator.

15. The dispenser of claim 12 wherein the curved push bar is hingedly connected to the frame.

16. The dispenser of claim 15 wherein the curved push bar is hingedly connected to the frame and is configured to pivot about the hinge and move upward with respect to the frame.

17. The dispenser of claim 12 further comprising a biasing member that biases the actuator to a rest position.

18. The dispenser of claim 12 wherein the bracket comprises a lower receptacle and an upper receptacle and wherein at least 50% of the container is visible.

19. The dispenser of claim 12 wherein the refill unit is removable from the refill unit frame by moving the refill unit upwards.

* * * * *